US008966932B2

(12) United States Patent
Lee et al.

(10) Patent No.: US 8,966,932 B2
(45) Date of Patent: Mar. 3, 2015

(54) REFRIGERATOR

(75) Inventors: Sang Hoon Lee, Yeoju-gun (KR); Mi Sun Park, Suwon-si (KR); Ji Young Lee, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 784 days.

(21) Appl. No.: 13/137,307

(22) Filed: Aug. 4, 2011

(65) Prior Publication Data

US 2012/0055191 A1 Mar. 8, 2012

(30) Foreign Application Priority Data

Sep. 6, 2010 (KR) ..... 10-2010-0087207

(51) Int. Cl.
*F25D 3/02* (2006.01)
*F25D 11/00* (2006.01)
*F25D 25/02* (2006.01)

(52) U.S. Cl.
CPC ..... *F25D 11/006* (2013.01); *F25D 25/02* (2013.01)
USPC ..... 62/459; 62/457.2; 62/521; 62/253; 312/408

(58) Field of Classification Search
USPC ..... 62/459, 521, 375, 457.2, 312, 253; 312/401, 116, 408, 407
See application file for complete search history.

(56) References Cited

U.S. PATENT DOCUMENTS

| | | | | |
|---|---|---|---|---|
| 60,716 | A * | 1/1867 | Gove | 62/459 |
| 68,258 | A * | 8/1867 | Sweetland | 62/381 |
| 3,971,231 | A * | 7/1976 | Derry | 62/388 |
| 4,565,074 | A * | 1/1986 | Morgan | 62/457.1 |
| 4,923,086 | A * | 5/1990 | Mahon et al. | 62/252 |
| 5,568,734 | A * | 10/1996 | Niemerg et al. | 62/378 |
| 6,131,404 | A * | 10/2000 | Hase et al. | 62/384 |
| 6,691,530 | B2 * | 2/2004 | Lee et al. | 62/378 |
| 7,260,438 | B2 * | 8/2007 | Caldwell et al. | 700/60 |
| 8,135,482 | B2 * | 3/2012 | Caldwell et al. | 700/60 |
| 8,474,274 | B2 * | 7/2013 | Schalla et al. | 62/89 |
| 2002/0050147 | A1 * | 5/2002 | Mai et al. | 62/457.2 |
| 2002/0088244 | A1 * | 7/2002 | Jennings et al. | 62/371 |
| 2002/0189278 | A1 * | 12/2002 | Defelice et al. | 62/457.2 |
| 2004/0031273 | A1 * | 2/2004 | Lanctot | 62/60 |
| 2004/0074242 | A1 * | 4/2004 | Crete | 62/60 |
| 2005/0188715 | A1 * | 9/2005 | Aragon | 62/371 |
| 2005/0193760 | A1 * | 9/2005 | Moran et al. | 62/371 |

(Continued)

FOREIGN PATENT DOCUMENTS

| | | |
|---|---|---|
| CN | 1459611 | 12/2003 |
| CN | 1636469 | 7/2005 |

(Continued)

OTHER PUBLICATIONS

Chinese Office Action issued Nov. 4, 2014 in corresponding Chinese Patent Application No. 201110259925.4.

*Primary Examiner* — Ljiljana Ciric
*Assistant Examiner* — Alexis Cox
(74) *Attorney, Agent, or Firm* — Staas & Halsey LLP

(57) ABSTRACT

A refrigerator having an ice thermal storage device. The refrigerator includes a cabinet, a storage compartment defined in the cabinet, and an ice thermal storage device placed in the storage compartment. The ice thermal storage device includes a case including at least one heat transfer plate, and an ice thermal storage pack received in the case and arranged to come into contact with the at least one heat transfer plate.

25 Claims, 13 Drawing Sheets

(56) References Cited

U.S. PATENT DOCUMENTS

| | | | | |
|---|---|---|---|---|
| 2011/0314849 | A1* | 12/2011 | Park et al. | 62/129 |
| 2012/0047922 | A1* | 3/2012 | Lee et al. | 62/89 |
| 2012/0072046 | A1* | 3/2012 | Tattam | 700/300 |
| 2013/0255306 | A1* | 10/2013 | Mayer | 62/457.2 |
| 2013/0340467 | A1* | 12/2013 | Kiedaisch et al. | 62/457.2 |

FOREIGN PATENT DOCUMENTS

| | | |
|---|---|---|
| CN | 201555416 | 8/2010 |
| JP | 2000-180046 | 6/2000 |
| JP | 2002-107078 | 4/2002 |

* cited by examiner

REFRIGERATOR

CROSS-REFERENCE TO RELATED APPLICATIONS

This application claims the benefit of Korean Patent Application No. 2010-0087207, filed on Sep. 6, 2010 in the Korean Intellectual Property Office, the disclosure of which is incorporated herein by reference.

BACKGROUND

1. Field

Embodiments relate to a refrigerator having an ice thermal storage device.

2. Description of the Related Art

Generally, a refrigerator is designed to keep stored items fresh for a long time using cold air supplied into a storage compartment thereof. The cold air supplied into the storage compartment is produced by heat-exchange of a refrigerant. The cold air is uniformly transferred throughout the storage compartment by convection, enabling storage of food at a desired temperature.

The storage compartment may be divided into a refrigerating compartment and a freezing compartment based on an interior temperature and a purpose thereof. The freezing compartment, which keeps food at a temperature below zero, may contain an ice thermal storage material, to enhance cooling efficiency of food.

The ice thermal storage material is sealed in a pack and is placed in the freezing compartment. In this case, if the pack enclosing the ice thermal storage material breaks, the ice thermal storage material is exposed to food, damaging the food. Moreover, if the ice thermal storage material varies in volume during phase change from liquid to solid, the ice thermal storage pack undergoes surface deformation, which may reduce a food contact area and cooling efficiency.

SUMMARY

It is an aspect to provide a refrigerator having an ice thermal storage device to enhance cooling efficiency.

Additional aspects will be set forth in part in the description which follows and, in part, will be apparent from the description, or may be learned by practice of the invention.

In accordance with one aspect, a refrigerator includes a cabinet, a storage compartment defined in the cabinet, and an ice thermal storage device placed in the storage compartment, wherein the ice thermal storage device includes a case including at least one heat transfer plate, and an ice thermal storage pack received in the case and arranged to come into contact with the at least one heat transfer plate.

The case may include an expansion induction region to provide an expansion space for the ice thermal storage pack, so as to maintain contact between the ice thermal storage pack and the heat transfer plate.

The case may include an upwardly protruding support bar spaced apart from an inner surface of the case by a predetermined distance and serving to support a lateral surface of the ice thermal storage pack.

The support bar may include a first support bar and a second support bar to support opposite lateral surfaces of the ice thermal storage pack respectively.

An upper end of the support bar may be located lower than an upper surface of the ice thermal storage pack.

The expansion induction region may be defined by a space between the upper end of the support bar and the inner surface of the case, and the ice thermal storage pack may be expandable into the expansion induction region.

The case may include an air-bubble guide region to guide interior air of the ice thermal storage pack during expansion of the ice thermal storage pack, so as to maintain contact between the ice thermal storage pack and the heat transfer plate.

The air-bubble guide region may be defined by a space above an upper edge of the ice thermal storage pack.

The heat transfer plate may be located above the air-bubble guide region.

The case may include a housing configured to receive the ice thermal storage pack therein and to support the heat transfer plate coupled thereto, and the housing may be located above the air-bubble guide region.

The case may include a first housing in which the ice thermal storage pack is received and a second housing to which the heat transfer plate is coupled, and the first housing and the second housing may be coupled to each other such that the heat transfer plate comes into close contact with the ice thermal storage pack.

The first housing may include an assembly groove for coupling of the second housing, and an end of the second housing, extending angularly from an upper surface of the second housing, may be fitted into the assembly groove.

The first housing may include an upwardly protruding fastening piece, the heat transfer plate may include a fastening hole provided at a position corresponding to the fastening piece, the second housing may include a downwardly open fastening recess provided at a position corresponding to the fastening piece, and the ice thermal storage device may be assembled as the fastening piece is successively fastened into the fastening hole and the fastening recess.

The ice thermal storage pack may include a fixing hole, the case may further include a fixing pin protruding toward the fixing hole so as to correspond to the fixing hole, and the ice thermal storage pack may be kept at a fixed position as the fixing pin is inserted into the fixing hole.

The case may further include a load carrying member to carry the heat transfer plate.

The load carrying member may divide the interior of the case into a plurality of spaces, and a plurality of ice thermal storage packs may be arranged respectively in the plurality of spaces.

The heat transfer plate may include a first heat transfer plate and a second heat transfer plate to come into contact with upper and lower surfaces of the ice thermal storage pack respectively.

The refrigerator may further include a shelf secured to an inner wall of the storage compartment, and the ice thermal storage device may be coupled to the shelf.

The shelf may include a support member fixed to the inner wall of the storage compartment and a shelf member slidably fitted into the support member, and the shelf member may include a seating recess indented to have a shape corresponding to that of the ice thermal storage device.

The refrigerator may further include a guide provided at the inner wall of the storage compartment, and the ice thermal storage device may further include a coupling portion coupled to the guide, the ice thermal storage device serving as a shelf.

The refrigerator may further include a storage container received in the storage compartment to provide a separate storage space, and the ice thermal storage device may be mounted to a lower surface of the storage container.

The heat transfer plate may be made of a metallic material.

The heat transfer plate may include a coating layer formed on at least one surface thereof.

In accordance with another aspect, an ice thermal storage device includes a case including at least one heat transfer plate, and an ice thermal storage pack received in the case and arranged to come into contact with the at least one heat transfer plate.

The case may include an expansion induction region to provide an expansion space for the ice thermal storage pack, so as to maintain contact between the ice thermal storage pack and the heat transfer plate.

The case may include an upwardly protruding support bar spaced apart from an inner surface of the case by a predetermined distance and serving to support a lateral surface of the ice thermal storage pack, and an upper end of the support bar may be located lower than an upper surface of the ice thermal storage pack.

The expansion induction region may be defined by a space between the upper end of the support bar and the inner surface of the case, and the ice thermal storage pack may be expandable into the expansion induction region.

The case may include an air-bubble guide region to guide interior air of the ice thermal storage pack during expansion of the ice thermal storage pack, so as to maintain contact between the ice thermal storage pack and the heat transfer plate.

The air-bubble guide region may be defined by a space above an upper edge of the ice thermal storage pack.

The case may further include a load carrying member to carry the heat transfer plate and divide the interior of the case into a plurality of spaces, and a plurality of ice thermal storage packs may be arranged respectively in the plurality of spaces.

The heat transfer plate may include a first heat transfer plate and a second heat transfer plate to come into contact with upper and lower surfaces of the ice thermal storage pack respectively.

The heat transfer plate may be made of a metallic material.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
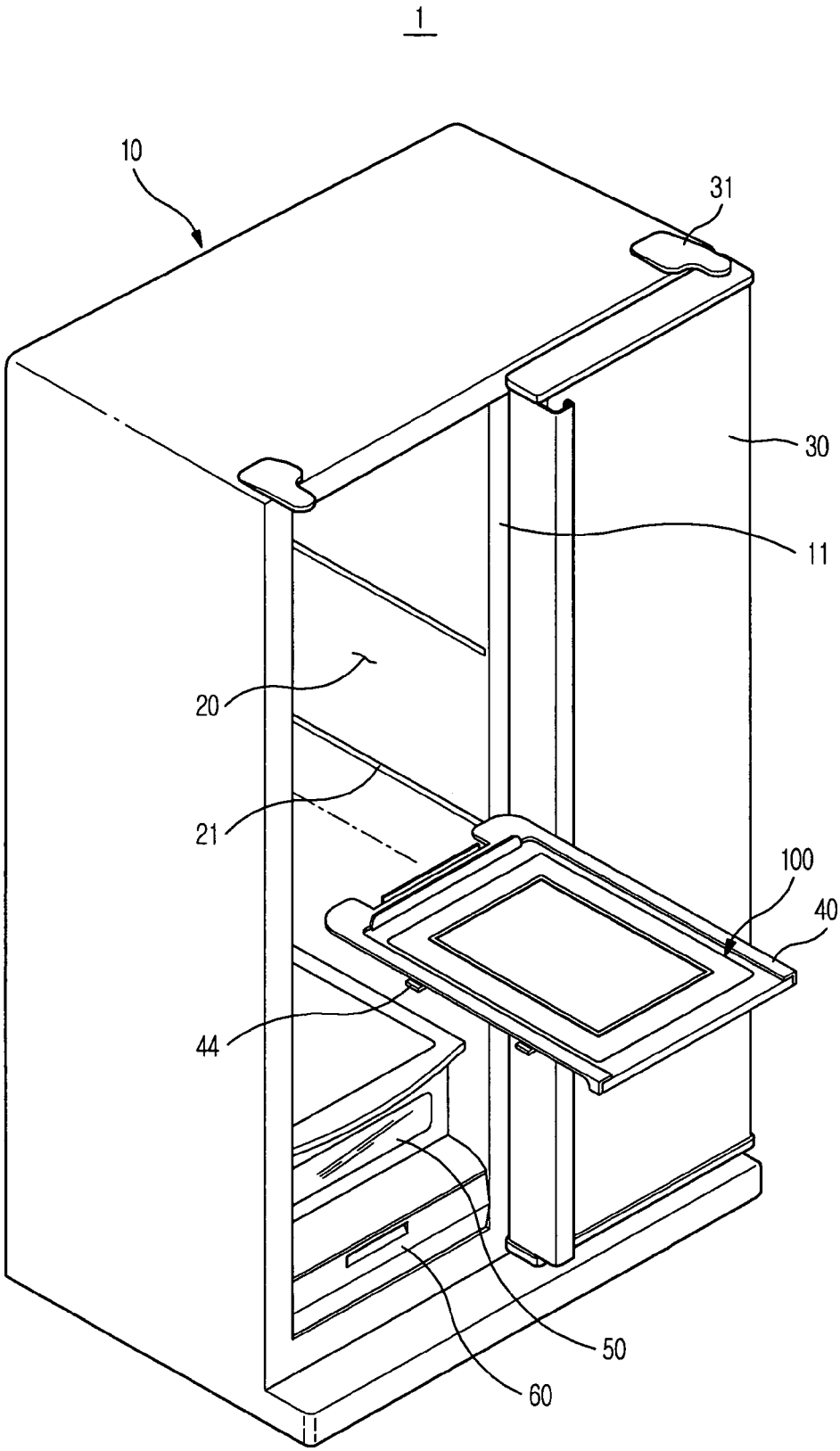
FIG. 1 is a perspective view illustrating major components of a refrigerator in accordance with an embodiment.

Reference will now be made in detail to the exemplary embodiments, examples of which are illustrated in the accompanying drawings, wherein like reference numerals refer to like elements throughout.

FIG. 1 is a perspective view illustrating major components of a refrigerator in accordance with an embodiment.

As illustrated in FIG. 1, the refrigerator 1 includes a cabinet 10 defining a storage compartment 20, and a door 30 to open or close the storage compartment 20.

The door 30 is pivotally rotatable relative to the cabinet 10 to open or close the storage compartment 20. To enable pivotal rotation of the door 30 relative to the cabinet 10, a hinge 31 is coupled to at least one of upper and lower ends of the door 30.

The storage compartment 20 is defined in the cabinet 10 and functions to keep food at a low temperature. There may be a plurality of storage compartments 20 as necessary. The plurality of storage compartments 20 is separated from one another by a partition 11 provided in the cabinet 10.

A first storage container 50 and a second storage container 60 may be arranged in a lower region of the storage compartment 20 so as to provide separate storage spaces. The first and second storage containers 50 and 60 are slidable relative to the storage compartment 20.

A shelf assembly 40 may be placed in the storage compartment 20 to divide the storage compartment 20 into a plurality of spaces. The shelf assembly 40 may be secured to, or be slidable relative to an inner wall of the storage compartment 20.

Food stored in the storage compartment 20 is cooled by cold air generated from an evaporator (not shown). The cold air enables uniform cooling of food within the storage compartment 20. Note that cold air has no ability to cool only specific food rapidly.

Accordingly, to enhance cooling efficiency of food stored in the storage compartment 20, the refrigerator includes an ice thermal storage device 100 provided to come into contact with food.

Figure 2:
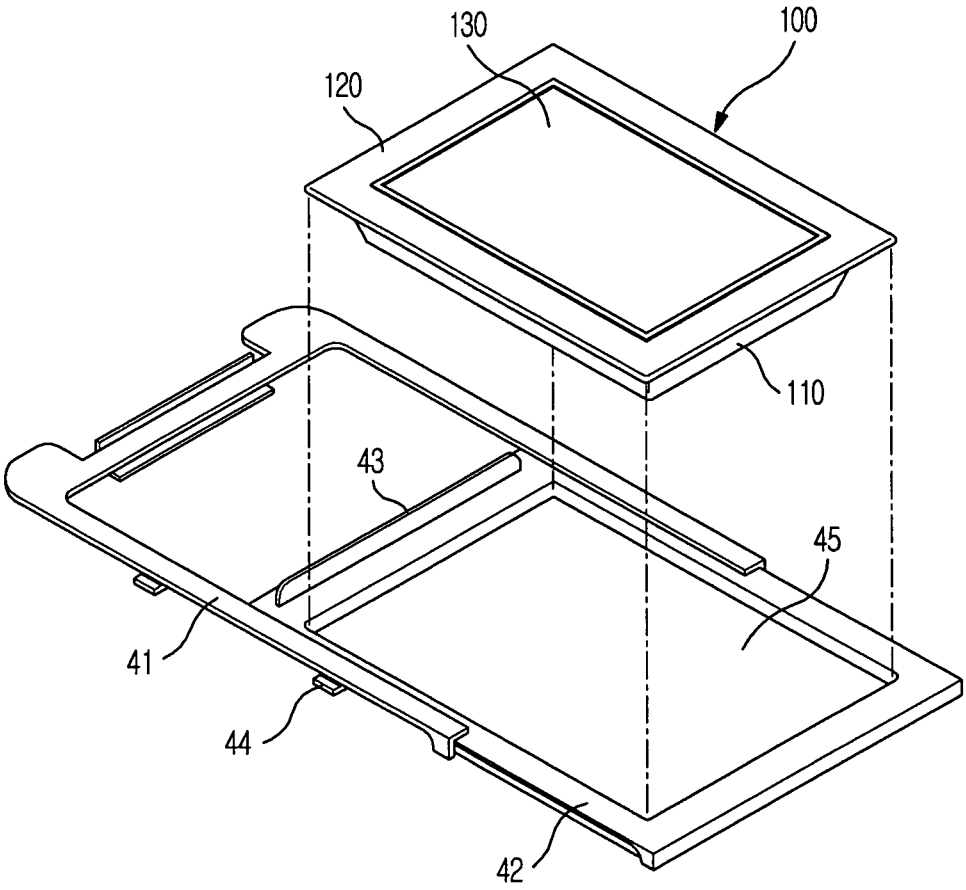
FIG. 2 is a perspective view illustrating a shelf assembly provided in the refrigerator in accordance with the embodiment.

FIG. 2 is a perspective view illustrating the shelf assembly of the refrigerator in accordance with the embodiment.

As illustrated in FIG. 2, the shelf assembly 40 includes a support frame 41 coupled to the inner wall of the storage compartment 20 and a shelf 42 fitted into the support frame 41.

The inner wall of the storage compartment 20 is provided with a support structure 21 and the support frame 41 is provided with a mounting structure 44 corresponding to the support structure 21. The support structure 21 may be a groove indented in the inner wall of the storage compartment 20 and the mounting structure 44 may be a protrusion corresponding to the groove. Of course, conversely, the support structure 21 may be a protrusion and the mounting structure 44 may be a corresponding groove.

The shelf 42 may be slidably fitted into the support frame 41. As such, when attempting to take out food placed on the shelf 42, the shelf 42 is pulled out so as to be slidably moved out of the storage compartment 20. In this case, the support frame 41 is provided with a plurality of stoppers (not shown), realizing stepwise sliding movement of the shelf 42.

The sliding movement of the shelf 42 out of the storage compartment 20 may cause food placed on the shelf 42 to fall rearward. To prevent this, the shelf 42 is provided at a rear end thereof with an anti-fall bar 43 having a predetermined height.

The ice thermal storage device 100 may be coupled to the shelf 42. The shelf 42 may have a seating recess 45 having a shape corresponding to the ice thermal storage device 100 such that the ice thermal storage device 100 is seated in the seating recess 45. Once the ice thermal storage device 100 is seated into the seating recess 45 and is coupled to the shelf 42, food is placed on an upper surface of the ice thermal storage device 100. As food comes into contact with the ice thermal storage device 100 having a relatively low temperature, efficient cooling of food may be possible.

Figure 3:
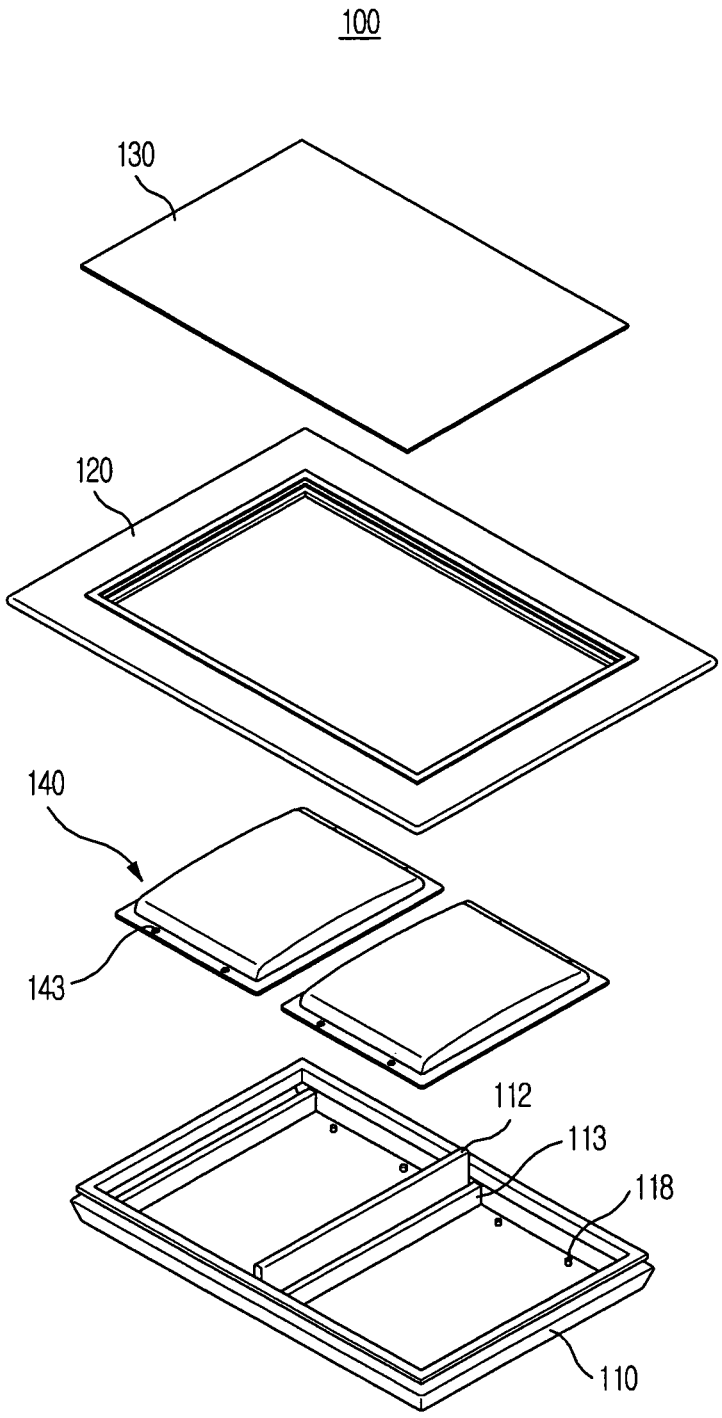
FIG. 3 is an exploded perspective view illustrating an ice thermal storage device in accordance with the embodiment.
Figure 4A:
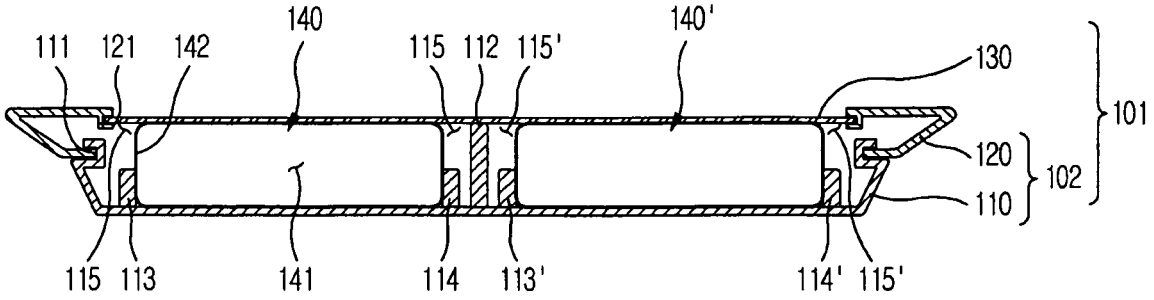
FIG. 4A is a sectional view of the ice thermal storage device in accordance with the embodiment.

FIG. 3 is an exploded perspective view illustrating the ice thermal storage device in accordance with the embodiment, and FIG. 4A is a sectional view of the ice thermal storage device in accordance with the embodiment.

As illustrated in FIGS. 3 and 4A, the ice thermal storage device 100 includes an ice thermal storage pack 140 in which an ice thermal material 141 is sealed, and a case 101 in which the ice thermal storage pack 140 is received.

The ice thermal storage material 141 may be phase change material (PCM), which is in liquid phase at a room temperature and is changed to a solid phase at a temperature of the storage compartment 20 when the ice thermal storage device 100 is placed in the storage compartment 20 as illustrated in FIG. 1. The ice thermal storage material 141 may increase or decrease in volume while undergoing phase change from liquid to solid, or vice versa. For example, the ice thermal storage material 141 may be any one of water, a mixture of water and a PCM, and other aqueous solutions. The constituent components of the ice thermal storage material 141 may be determined based on the temperature of the storage compartment 20 illustrated in FIG. 1.

The ice thermal storage material 141 is sealed by an enclosure 142 surrounding the ice thermal storage material 141. Since the ice thermal storage material 141 may increase or decrease in volume during phase change, the enclosure 142 is made of an elastic material to cope with the volume change of the ice thermal storage material 141. For example, the enclosure 142 is made of a synthetic resin film, such as a polyethylene film. The ice thermal storage pack 140 may be fabricated by sandwiching the ice thermal storage material 141 between two synthetic resin films and attaching rims of the synthetic resin films.

To fix the ice thermal storage pack 140 within the case 101, the ice thermal storage pack 140 may be provided with a fixing hole 143. The fixing hole 143 may be located at a bonding region of the synthetic resin films and a plurality of fixing holes may be provided as necessary.

The case 101 includes a housing 102 in which the ice thermal storage pack 140 is received, and a heat transfer plate 130 coupled to the housing 102 so as to come into contact with the ice thermal storage pack 140.

The housing 102 defines an external appearance of the ice thermal storage device 100. The housing 102 may have a top opening in which the heat transfer plate 130 is located. The housing 102 may include a first housing 110 defining a bottom surface and a second housing 120 coupled to the first housing 110 to support the heat transfer plate 130 coupled thereto.

The rim of the first housing 110 may be bent upward to define a sidewall of the case 101. An assembly groove 111 is formed in an upper end of the first housing 110, and a lower end of the second housing 120 is configured so as to be fitted into the assembly groove 111, enabling engagement of the first housing 110 and the second housing 120.

The second housing 120 is provided with rails 121 to which the heat transfer plate 130 is slidably fitted. The rails 121 may be attached to an inner ceiling surface of the second housing 120 to extend in a longitudinal direction of the heat transfer plate 130 by a predetermined length. More particularly, two rails 121 may be provided to support opposite sides of the heat transfer plate 130 respectively.

The heat transfer plate 130 is located above the ice thermal storage pack 140 such that a lower surface of the heat transfer plate 130 comes into contact with the ice thermal storage pack 140. The heat transfer plate 130 assists efficient heat-exchange between relative hot food and the relatively cold ice thermal storage pack 140, which increases cooling efficiency of food.

Most heat transfer between the heat transfer plate 130 and the ice thermal storage pack 140 is performed by conduction and therefore, the greater the contact area between the heat transfer plate 130 and the ice thermal storage pack 140, the greater the cooling efficiency of the heat transfer plate 130. When the ice thermal storage material 141 within the ice thermal storage pack 140 is in liquid phase, the ice thermal storage pack 140 may be deformed in shape by external force. Thus, upon assembly of the case 101, the heat transfer plate 130 is assembled to apply pressure to the ice thermal storage pack 140 such that the lower surface of the heat transfer plate 130 comes into contact with the upper surface of the ice thermal storage pack 140.

The heat transfer plate 130 may be made of a metallic material and more particularly, a metal having high thermal conductivity and chemical stability against water. For example, the heat transfer plate 130 is made of an aluminum alloy.

A surface of the heat transfer plate 130 may be cooled to a temperature below zero, which may cause injury to a user hand when the user's hand touches the metallic heat transfer plate 130 when attempting to take out food. To prevent such injury, a coating layer (not shown) may be formed on an upper surface of the heat transfer plate 130 on which food is placed. The coating layer may be made of a general material used to coat a metallic surface. For example, fluorine coating or synthetic resin coating may be used.

In a state in which food is placed on the upper surface of the heat transfer plate 130, the case 101 containing the heat transfer plate 130 receives load of food. To prevent deformation or damage to the case 101 by the load of the food, a load carrying member 112 is provided in the housing 102 to carry the load of the food applied to the heat transfer plate 130. In consideration of the fact that the load of the food is applied downward, the load carrying member 112 is vertically installed such that a lower end thereof is fixed on an inner bottom surface of the housing 102 and an upper end thereof comes into contact with the heat transfer plate 130 to carry it. The load carrying member 112 may be formed integrally with the housing 102.

The load carrying member 112 may extend in a longitudinal direction of the housing 102 to divide the interior space of the housing 102 into two spaces. Ice thermal storage packs 140 and 140' may be arranged respectively in the spaces divided by the load carrying member 112.

Support bars 113 and 114 may extend in a longitudinal direction of the ice thermal storage pack 140 to support lateral surfaces of the ice thermal storage pack 140. The support bars 113 and 114 may be fixed on the inner bottom surface of the housing 102. At least a part of the lateral surface of the ice thermal storage pack 140 does not come into contact with the corresponding support bar 113 or 114, to enable formation of an expansion induction region 115 which will be described hereinafter. Specifically, upper ends of the support bars 113 and 114 are located lower than the upper surface of the ice thermal storage pack 140. The support bars 113 and 114 may include a first support bar 113 and a second support bar 114 to support opposite lateral surfaces of the ice thermal storage pack 140.

The housing 102 may be provided at the inner bottom surface thereof with a fixing pin 118 corresponding to the fixing hole 143. As the fixing pin 118 is fastened into the fixing hole 143, the ice thermal storage pack 140 may be kept at a fixed position. Note that a plurality of fixing pins 118 and a plurality of fixing holes 143 may be provided.

The expansion induction region 115 is defined between the upper ends of the support bars 113 and 114 and the inner ceiling surface of the case 101. The expansion induction region 115 extends in a longitudinal direction of the support bars 113 and 114 along the upper ends of the support bars 113 and 114. When the ice thermal storage material 141 undergoes phase change from liquid to solid and the volume of the ice thermal storage pack 140 increases, a portion of the ice thermal storage pack 140 supported by the support bars 113 and 114 is limited in expansion and therefore, the remaining lateral surfaces of the ice thermal storage pack 140 not supported by the support bars 113 and 114 may expand in a longitudinal direction of the heat transfer plate 130 into the expansion induction region 115. Allowing expansion of only a part of the ice thermal storage pack 140 into the expansion induction region 115 other than the entire lateral surface of the ice thermal storage pack 140 may assure that the lower surface of the heat transfer plate 130 continuously comes into close contact with the upper surface of the ice thermal storage pack 140. As such, high cooling efficiency may be maintained even if the ice thermal storage pack 140 is deformed due to phase change of the ice thermal storage material 141.

Figure 4B:
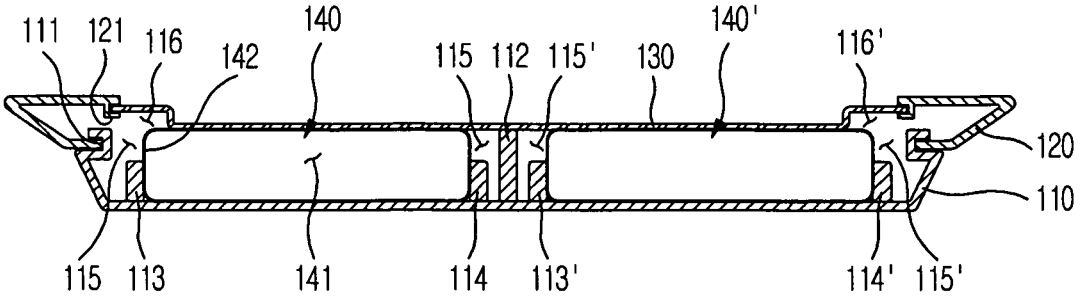
FIG. 4B is a sectional view of an ice thermal storage device in accordance with another embodiment.
Figure 4C:
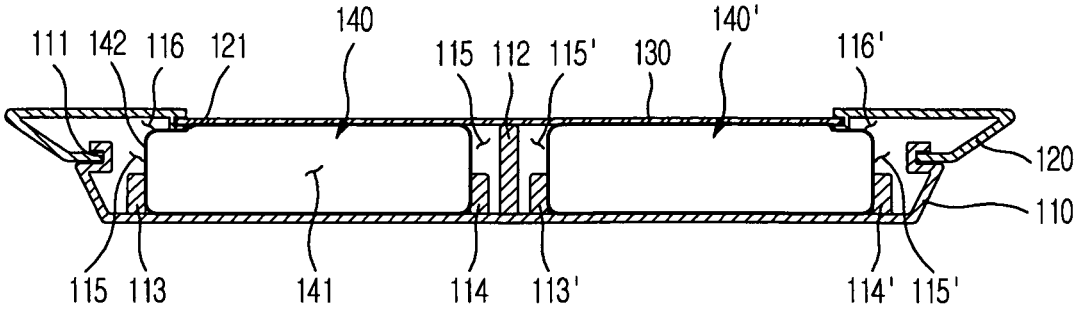
FIG. 4C is a sectional view of an ice thermal storage device in accordance with another embodiment.

FIG. 4B is a sectional view of the ice thermal storage device in accordance with another embodiment, and FIG. 4C is a sectional view of the ice thermal device in accordance with another embodiment.

Variation in the volume of the ice thermal storage material 141 may cause the enclosure of the ice thermal storage material 141 to break due to pressure applied from the ice thermal storage material 141. To prevent breakage of the enclosure 142, a predetermined quantity of air may be present in the form of bubbles within the ice thermal storage pack 140 along with the ice thermal storage material 141. The air tends to be reduced in volume when the volume of the ice thermal storage material 141 increases via phase change to a solid. Such a reduction in the volume of the air may offset the increase in the volume of the ice thermal storage material 141 even if the volume of the ice thermal storage pack 140 does not increase. As such, the air acts to reduce pressure applied to the enclosure 142 by the ice thermal storage material 141, preventing breakage of the enclosure 142.

The air has a lower density than the ice thermal storage material 141 and may be located above the ice thermal storage material 141 within the ice thermal storage pack 140. Also, the air has a lower thermal conductivity than the heat transfer plate 130 and may deteriorate heat transfer between the ice thermal storage material 141 and the heat transfer plate 130.

An air-bubble guide region 116 is provided to guide upward expansion of an upper edge of the ice thermal storage pack 140. The air, which has a lower density than the ice thermal storage material 141, may be collected in the air-bubble guide region 116. The air-bubble guide region 116 may be provided near the expansion induction region 115.

The air-bubble guide region 116 may be provided between the upper edge of the ice thermal storage pack 140 and the heat transfer plate as illustrated in FIG. 4B, or may be provided between the upper edge of the ice thermal storage pack 140 and the housing 102 as illustrated in FIG. 4C.

Figure 5:
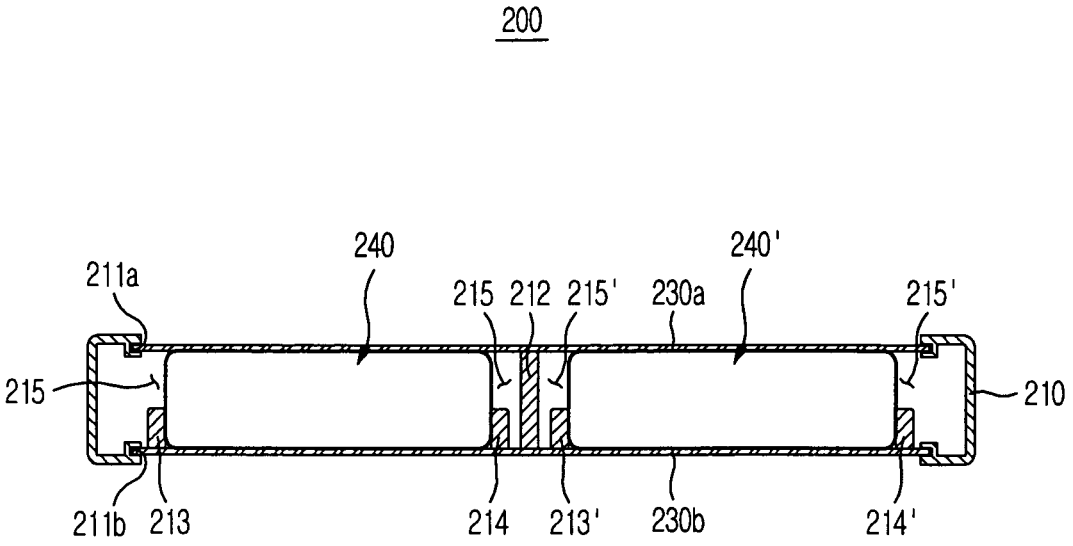
FIG. 5 is a sectional view of an ice thermal storage device in accordance with another embodiment.

FIG. 5 is a sectional view of an ice thermal storage device in accordance with another embodiment.

As illustrated in FIG. 5, the ice thermal storage device 200 includes an ice thermal storage pack 240, a first heat transfer plate 230*a* and a second heat transfer plate 230*b* arranged to come into contact with upper and lower surfaces of the ice thermal storage pack 240 respectively, and a housing 210 to which the first heat transfer plate 230*a* and the second heat transfer plate 230*b* are coupled.

The housing 210 may be provided with rails 211*a* and 211*b* for coupling of the first and second heat transfer plates 230*a* and 230*b*. The first heat transfer plate 230*a* and the second heat transfer plate 230*b* are slidably fitted into the respective rails 211*a* and 211*b*. The first heat transfer plate 230*a* and the second heat transfer plate 230*b* may have the same configuration as the heat transfer plate 130 illustrated in FIGS. 3 and 4A.

Support bars 213 and 214 and a load carrying member 212 may be secured to the housing 210 to extend between opposite inner wall surfaces of the housing 210.

The ice thermal storage device 200 may perform heat transfer through upper and lower sides thereof. Food located on the first heat transfer plate 230*a* may be directly cooled by coming into contact with the first heat transfer plate 230*a*, whereas food located below the second heat transfer plate 230*b* may be indirectly cooled by cold air which is generated by heat exchange with the second heat transfer plate 230*b*.

Figure 6A:
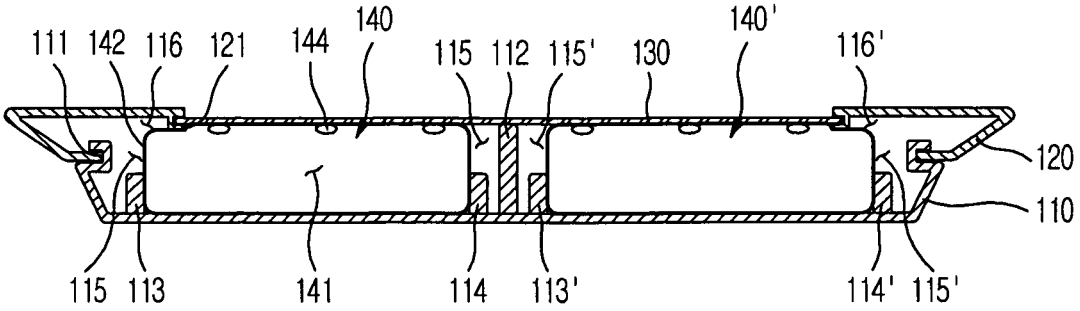
FIGS. 6A and 6B are views illustrating expansion of the ice thermal storage pack of the ice thermal storage device in accordance with different embodiments.
Figure 6B:
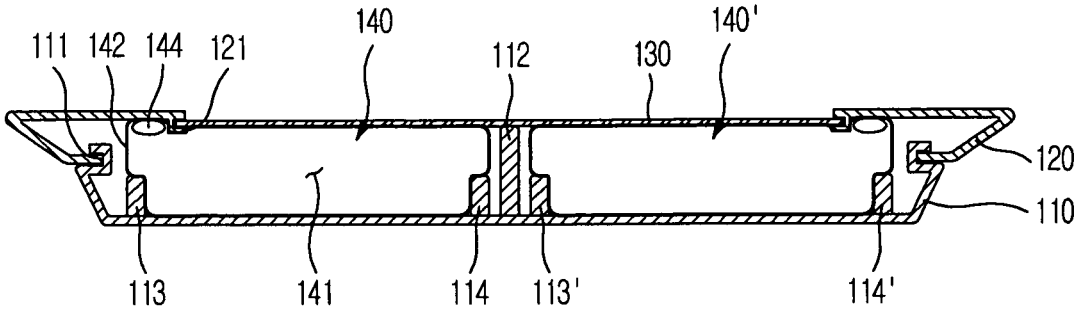

FIGS. 6A and 6B are views illustrating expansion of the ice thermal storage pack included in the ice thermal storage device in accordance with different embodiments.

The ice thermal storage material 141 illustrated in FIG. 6A is in liquid phase. The ice thermal storage pack 140 is supported at opposite sides thereof by the first support bar 113 and the second support bar 114. Air 144, which is present in the ice thermal storage pack 140 along with the ice thermal storage material 141, occupies an upper interior space of the ice thermal storage pack 140. The volume of the ice thermal storage material 141 expands if the ice thermal storage material 141 is changed to a solid phase under the influence of the surrounding low temperature.

The ice thermal storage material 141 illustrated in FIG. 6B is in a solid phase. Expansion of a portion of the ice thermal storage pack 140 in contact with the support bars 113 and 114 is limited, which causes the ice thermal storage pack 140 to be expanded into the expansion induction region 115. In this case, the ice thermal storage pack 140 may maintain constant contact with the heat transfer plate 130. In addition, since the air 144 present in the ice thermal storage pack 140 is likely to be collected into the air-bubble guide region 116 during expansion of the ice thermal storage pack 140, it may be possible to prevent the air 144 from hindering heat transfer between the heat transfer plate 130 and the ice thermal storage material 141.

Figure 7:
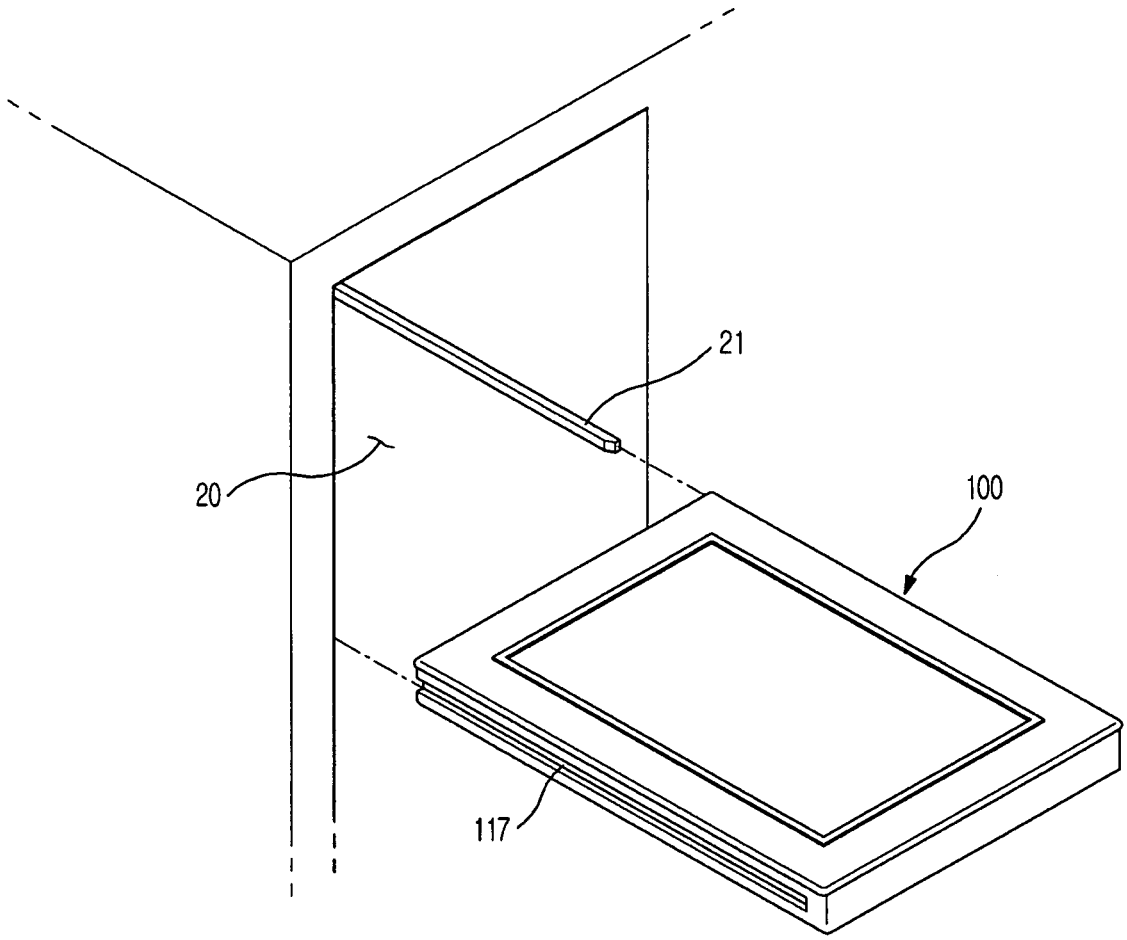
FIG. 7 is a perspective view illustrating the ice thermal device in accordance with another embodiment.

FIG. 7 is a perspective view illustrating the ice thermal device in accordance with another embodiment.

As illustrated in FIG. 7, the ice thermal storage device 100 may be mounted in the storage compartment 20.

The inner wall of the storage compartment 20 is provided with the support structure 21 and the ice thermal storage device 100 is externally provided with a mounting structure 117 corresponding to the support structure 21. The support structure 21 may be a groove indented in the inner wall of the storage compartment 20 and the mounting structure 117 may be a protrusion corresponding to the groove. Of course, conversely, the support structure 21 may be a protrusion and the mounting structure 117 may be a corresponding groove.

The ice thermal storage device 200 illustrated in FIG. 5 may be mounted in the storage compartment 20 in the same manner.

Figure 8:
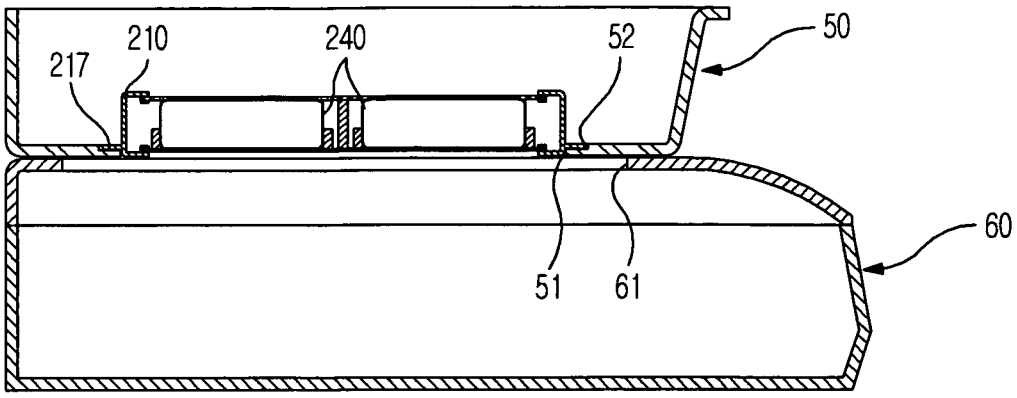
FIG. 8 is a sectional view illustrating an ice thermal storage device in accordance with another embodiment.

FIG. 8 is a sectional view illustrating an ice thermal storage device in accordance with another embodiment.

As illustrated in FIG. 8, the first storage container 50 may have a bottom opening 51 and a seating recess 52 around the opening 51. The second storage container 60 may have a top opening 61.

The ice thermal storage device 200 may be provided at an outer periphery thereof with a seating protrusion 217 having a shape corresponding to that of the seating recess 52. As the seating protrusion 217 is fitted into the seating recess 52, the ice thermal storage device 200 is mounted to the first storage container 50.

Food received in the first storage container 50 above the first heat transfer plate 230*a* may be cooled by the ice thermal storage pack 240. Food received in the second storage container 60 may be indirectly cooled as interior cold air of the second storage container 60 is cooled by a lower surface of the second heat transfer plate 230*b*.

Figure 9A:
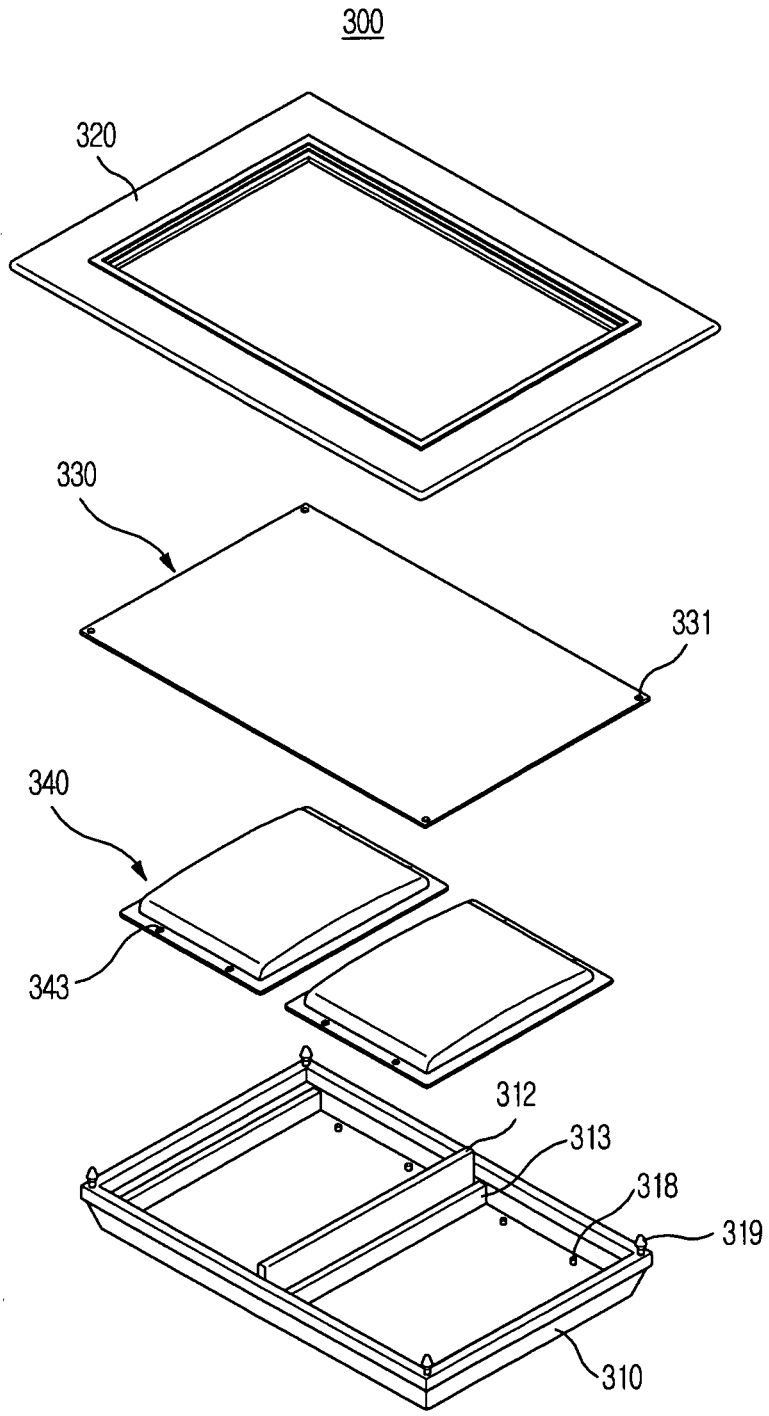
FIG. 9A is a perspective view illustrating an ice thermal storage device in accordance with a further embodiment.
Figure 9B:
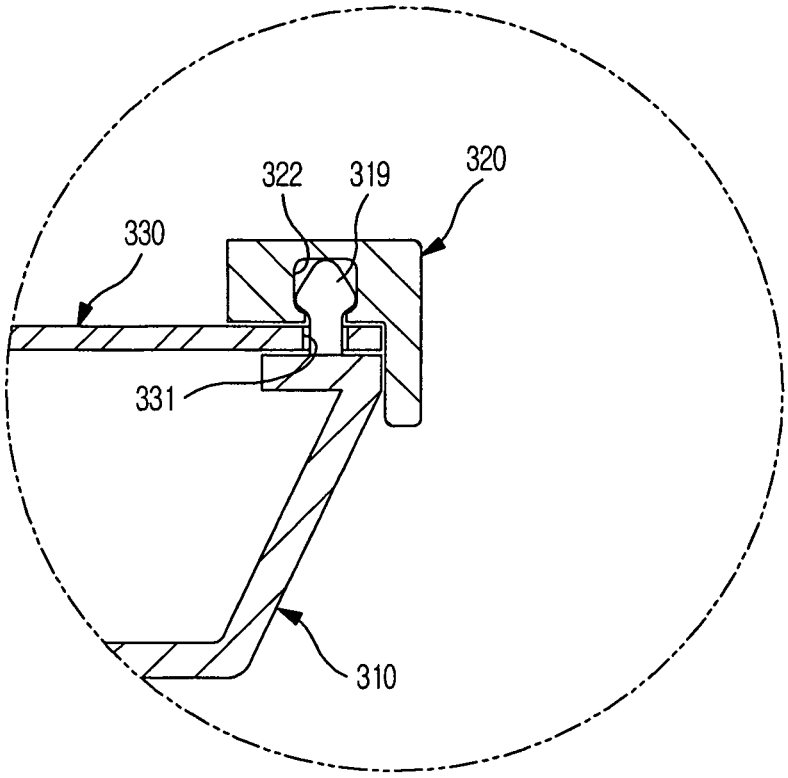
FIG. 9B is a sectional view of the ice thermal storage device illustrated in FIG. 9A.

FIG. 9A is a perspective view illustrating an ice thermal storage device in accordance with a further embodiment, and FIG. 9B is a sectional view of the ice thermal storage device illustrated in FIG. 9A.

As illustrated in FIGS. 9A and 9B, an ice thermal storage device 300 includes an ice thermal storage pack 340, a heat transfer plate 330 arranged to come into contact with the ice thermal storage pack 340, a first housing 310 in which the ice thermal storage pack 340 is received, and a second housing 320 coupled to the first housing 310.

The ice thermal storage pack 340 is identical to the ice thermal storage pack 140 illustrated in FIG. 3. In addition, the ice thermal storage pack 340 is fixed to the first housing 310 in the same method as that as illustrated in FIG. 3.

The first housing 310 is provided at corners thereof with upwardly-protruding fastening pieces 319. To correspond to the respective fastening pieces 319, the heat transfer plate 330 is provided with fastening holes 331 and the second housing 320 is provided with fastening recesses 322. The heat transfer plate 330 may be secured to the top of the first housing 310 as the fastening pieces 319 penetrate the fastening holes 331. Then, the second housing 320 may be coupled to the first housing 310 as the fastening pieces 319 are inserted into the fastening recesses 322 and simultaneously, may apply pressure to the heat transfer plate 330 so as to secure the heat transfer plate 330. As such, the heat transfer plate 330 and the second housing 320 are successively coupled using the fastening pieces 319, which results in easy assembly and simplified manufacture of the ice thermal storage device 300.

As is apparent from the above description, according to one embodiment, an ice thermal storage pack usable with a refrigerator is configured to maintain constant contact with a heat transfer plate even if the volume of the ice thermal storage pack increases due to phase change of an ice thermal storage material sealed in the ice thermal storage pack. The ice thermal storage pack has the effect of continuously maintaining cooling efficiency of food. Further, the ice thermal storage pack is received in a case that protects the ice thermal storage pack from external shock, having no risk of breakage.

Furthermore, even if the ice thermal storage pack breaks within the case, the case prevents leakage of the ice thermal storage pack, which prevents damage to food due to the leakage of the ice thermal storage pack.

Although the embodiment has been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a cabinet;

a storage compartment defined in the cabinet; and an ice thermal storage device placed in the storage compartment, wherein the ice thermal storage device includes a case including at least one heat transfer plate; and an ice thermal storage pack received in the case and arranged to come into contact with the at least one heat transfer plate, wherein the case includes an expansion induction region to provide an expansion space for the ice thermal storage pack, so as to maintain contact between the ice thermal storage pack and the heat transfer plate, and the case includes at least one support bar upwardly protruding from an inner surface of the case by a predetermined distance and serving to support a lateral surface of the ice thermal storage pack, wherein an upper end of the at least one support bar is located lower than an upper surface of the ice thermal storage pack, and the expansion induction region is defined by a space between the upper end of the at least one support bar and the inner surface of the case, and the ice thermal storage pack is expandable into the expansion induction region.

2. The refrigerator according to claim 1, wherein the case includes an air-bubble guide region to guide interior air of the ice thermal storage pack during expansion of the ice thermal storage pack, so as to maintain contact between the ice thermal storage pack and the heat transfer plate.

3. The refrigerator according to claim 2, wherein the air-bubble guide region is defined by a space above an upper edge of the ice thermal storage pack.

4. The refrigerator according to claim 2, wherein the heat transfer plate is located above the air-bubble guide region.

5. The refrigerator according to claim 2, wherein:

the case includes a housing configured to receive the ice thermal storage pack therein and to support the heat transfer plate coupled thereto; and the housing is located above the air-bubble guide region.

6. The refrigerator according to claim 1, wherein:

the case includes a first housing in which the ice thermal storage pack is received and a second housing to which the heat transfer plate is coupled; and the first housing and the second housing are coupled to each other such that the heat transfer plate comes into contact with the ice thermal storage pack.

7. The refrigerator according to claim 6, wherein:

the first housing includes an assembly groove for coupling of the second housing; and a lower end of the second housing, extending downwardly from an upper surface of the second housing, is fitted into the assembly groove.

8. The refrigerator according to claim 1, wherein the case further includes a load carrying member to carry the heat transfer plate.

9. The refrigerator according to claim 8, wherein:

the load carrying member divides the interior of the case into a plurality of spaces; and a plurality of ice thermal storage packs is arranged respectively in the plurality of spaces.

10. The refrigerator according to claim 1, further comprising a shelf secured to an inner wall of the storage compartment, wherein the ice thermal storage device is coupled to the shelf.

11. The refrigerator according to claim 10, further comprising a support member fixed to the inner wall of the storage compartment, wherein the shelf is slidably fitted into the support member, and the shelf includes a seating portion indented to have a shape corresponding to that of the ice thermal storage device.

12. The refrigerator according to claim 1, wherein the heat transfer plate is made of a metallic material.

13. The refrigerator according to claim 12, wherein the heat transfer plate includes a coating layer formed on at least one surface thereof.

14. The refrigerator according to claim 1, wherein the at least one support bar includes a first support bar and a second support bar to support opposite lateral surfaces of the ice thermal storage pack respectively.

15. The refrigerator according to claim 1, wherein the at least one heat transfer plate includes a first heat transfer plate and a second heat transfer plate to come into contact with upper and lower surfaces of the ice thermal storage pack respectively.

16. The refrigerator according to claim 1, further comprising a guide provided at the inner wall of the storage compartment, wherein the ice thermal storage device further includes a coupling portion coupled to the guide, the ice thermal storage device serving as a shelf.

17. The refrigerator according to claim 1, further comprising a storage container received in the storage compartment to provide a separate storage space, wherein the ice thermal storage device is mounted to a lower surface of the storage container.

18. A refrigerator comprising:

a cabinet;

a storage compartment defined in the cabinet; and an ice thermal storage device placed in the storage compartment, wherein the ice thermal storage device includes a case including at least one heat transfer plate; and an ice thermal storage pack received in the case and arranged to come into contact with the at least one heat transfer plate;

wherein the case includes a first housing in which the ice thermal storage pack is received and a second housing to which the heat transfer plate is coupled;

the first housing and the second housing are coupled to each other such that the heat transfer plate comes into contact with the ice thermal storage pack;

the first housing includes an upwardly protruding fastening piece;

the heat transfer plate includes a fastening hole provided at a position corresponding to the fastening piece, the fastening piece being inserted through the fastening hole;

the second housing includes a downwardly open fastening recess provided at a position corresponding to the fastening piece, the fastening recess being inserted over a top of the fastening piece and being configured to secure the top of the fastening piece when the fastening piece is inserted into the fastening recess, whereby the ice thermal storage device is assembled as the fastening piece is successively inserted through the fastening hole and inserted into and secured by the fastening recess.

19. A refrigerator comprising:

a cabinet;

a storage compartment defined in the cabinet; and an ice thermal storage device placed in the storage compartment, wherein the ice thermal storage device includes a case including at least one heat transfer plate; and an ice thermal storage pack received in the case and arranged to come into contact with the at least one heat transfer plate, wherein the ice thermal storage pack includes a fixing hole; and the case further includes a protruding fixing pin corresponding to the fixing hole, the ice thermal storage pack being kept at a fixed position by the fixing pin inserted into the fixing hole.

20. An ice thermal storage device comprising:

a case including at least one heat transfer plate; and an ice thermal storage pack received in the case and arranged to come into contact with the at least one heat transfer plate, wherein the case includes an expansion induction region to provide an expansion space for the ice thermal storage pack, so as to maintain contact between the ice thermal storage pack and the heat transfer plate, the case includes a support bar upwardly protruding from an inner surface of the case by a predetermined distance and serving to support a lateral surface of the ice thermal storage pack, and an upper end of the support bar is located lower than an upper surface of the ice thermal storage pack, and the expansion induction region is defined by a space between the upper end of the support bar and the inner surface of the case, and the ice thermal storage pack is expandable into the expansion induction region.

21. The ice thermal storage device according to claim 20, wherein the case includes an air-bubble guide region to guide interior air of the ice thermal storage pack during expansion of the ice thermal storage pack, so as to maintain contact between the ice thermal storage pack and the heat transfer plate.

22. The ice thermal storage device according to claim 21, wherein the air-bubble guide region is defined by a space above an upper edge of the ice thermal storage pack.

23. The ice thermal storage device according to claim 20, wherein:

the case further includes a load carrying member to carry the heat transfer plate and divide the interior of the case into a plurality of spaces; and a plurality of ice thermal storage packs is arranged respectively in the plurality of spaces.

24. The ice thermal storage device according to claim 20, wherein the at least one heat transfer plate includes a first heat transfer plate and a second heat transfer plate to come into contact with upper and lower surfaces of the ice thermal storage pack respectively.

25. The ice thermal storage device according to claim 20, wherein the heat transfer plate is made of a metallic material.

* * * * *